US007780016B1

(12) United States Patent
Cornwell et al.

(10) Patent No.: US 7,780,016 B1
(45) Date of Patent: Aug. 24, 2010

(54) TOOL HOLDER

(75) Inventors: W Robert Cornwell, Ronan, MT (US); Clint Henriksen, Polson, MT (US); David Tyler, Ronan, MT (US); Ian B Merwin, Ronan, MT (US)

(73) Assignee: Jore Corporation, Pasco, WA (US)

( * ) Notice: Subject to any disclaimer, the term of this patent is extended or adjusted under 35 U.S.C. 154(b) by 0 days.

(21) Appl. No.: 11/484,367

(22) Filed: Jul. 10, 2006

Related U.S. Application Data

(60) Provisional application No. 60/697,481, filed on Jul. 8, 2005.

(51) Int. Cl.
*A47F 7/00* (2006.01)

(52) U.S. Cl. ..... 211/69

(58) Field of Classification Search ..... 211/69, 211/70.6, 69.6, 69.1, 80, 69.2, 81; 206/372, 206/373, 379, 759, 762, 765, 349
See application file for complete search history.

(56) References Cited

U.S. PATENT DOCUMENTS

| | | | | |
|---|---|---|---|---|
| 2,736,426 | A * | 2/1956 | Hamilton | 206/379 |
| 3,074,539 | A * | 1/1963 | Rogovin | 206/379 |
| 4,669,617 | A * | 6/1987 | Boeckmann et al. | 211/69.7 |
| 4,880,122 | A * | 11/1989 | Martindell | 211/70.6 |
| 5,562,208 | A * | 10/1996 | Hasler et al. | 206/373 |
| 5,813,533 | A * | 9/1998 | Knoblauch | 206/379 |
| 5,927,493 | A * | 7/1999 | Colombo | 206/372 |
| 6,024,218 | A * | 2/2000 | Knoblauch | 206/379 |
| 6,405,864 | B1 * | 6/2002 | Streich et al. | 206/373 |
| 6,547,074 | B1 * | 4/2003 | Chen | 206/379 |
| 6,615,983 | B1 * | 9/2003 | Yu | 206/372 |
| 6,991,103 | B2 * | 1/2006 | Chen | 206/373 |
| 7,032,750 | B2 * | 4/2006 | Amtenbrink | 206/379 |
| 7,066,341 | B1 * | 6/2006 | Hartford | 211/85.13 |
| 7,168,559 | B2 * | 1/2007 | Chen | 206/373 |
| 7,188,726 | B2 * | 3/2007 | Lin | 206/373 |
| 7,328,796 | B2 | 2/2008 | Brunson | |
| 7,331,455 | B2 * | 2/2008 | Lin | 206/378 |
| 7,401,700 | B2 | 7/2008 | Dost | |
| 2003/0029755 | A1 * | 2/2003 | Ho | 206/320 |
| 2005/0211587 | A1 * | 9/2005 | Chen | 206/379 |
| 2005/0241974 | A1 | 11/2005 | Chen | |
| 2006/0070901 | A1 * | 4/2006 | Adams et al. | 206/373 |

* cited by examiner

*Primary Examiner*—Jennifer E. Novosad
(74) *Attorney, Agent, or Firm*—Christensen O'Connor Johnson Kindness PLLC

(57) ABSTRACT

A tool holder assembly is provided and includes a base portion and a holder portion. The holder portion is pivotably disposed within the base portion for reciprocating movement between a stored position and a removal position. The tool holder assembly also includes at least one interference member associated with one of either the base portion or the holder portion. The at least one interference member engaging a portion of the other of either the base portion or the holder portion and defining an interference fit therebetween for selectively restraining the holder portion in the stored position until a predetermined load is applied to overcome the interference fit.

11 Claims, 10 Drawing Sheets

TOOL HOLDER

CROSS-REFERENCE TO RELATED APPLICATION

This application claims the benefit of Provisional Application No. 60/697,481, filed Jul. 8, 2005, the disclosure of which is hereby expressly incorporated by reference.

BACKGROUND

Tool holders provide a convenient way for a user to keep his or her tools in an organized manner. Tool holders often include tool carriers having various attachment structures for holding specific tool accessories, such as bits, in known locations within the tool holder. This permits the tool accessories to be held in a known position for retrieval by the user while also presenting such tool accessories in an aesthetically pleasing manner.

Although previously developed tool holders are somewhat effective, they are not without their problems. For example, some tool holders use flip-out tool carriers which are rotatable between a flat (stored) position and an inclined (removal) position, in which a specific tool accessory can be selected and removed for use. However, during use, the tool carrier may inadvertently transition between the stored position and the removal position, causing the tool accessories to become dislodged within the tool carrier. Further, the tool carrier may inadvertently swing from the removal position to the stored position before a user has a chance to select and remove the tool from the tool carrier.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A tool holder assembly is provided and includes a base portion and a holder portion. The holder portion is pivotably disposed within the base portion for reciprocating movement between a stored position and a removal position. The tool holder assembly also includes at least one interference member associated with one of either the base portion or the holder portion. The at least one interference member engaging a portion of the other of either the base portion or the holder portion and defining an interference fit therebetween for selectively restraining the holder portion in the stored position until a predetermined load is applied to overcome the interference fit.

DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION

Figure 1:
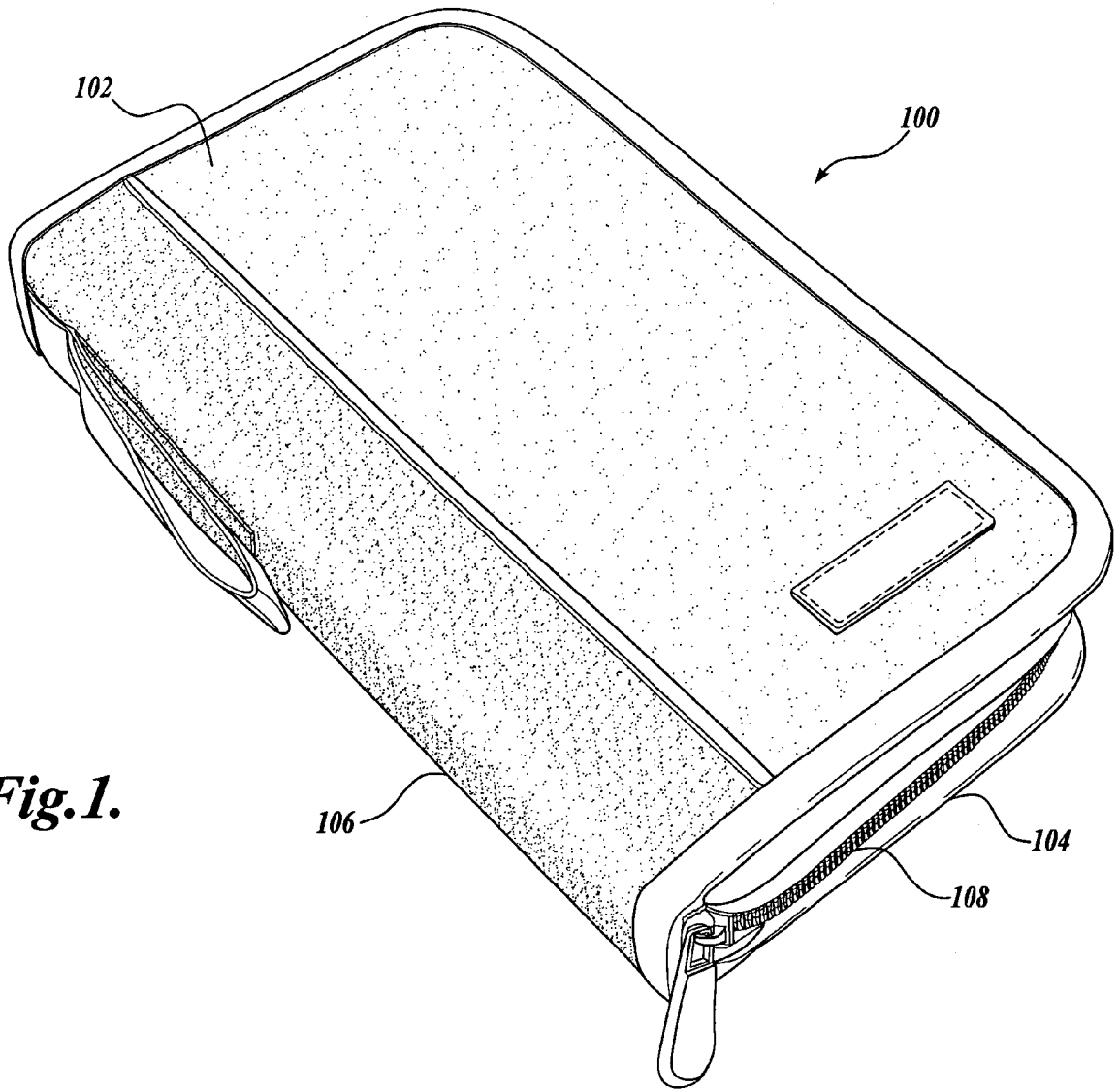
FIG. 1 is an isometric view of a tool holder constructed in accordance with one embodiment of the present disclosure, showing the tool holder in a closed position.
Figure 2:
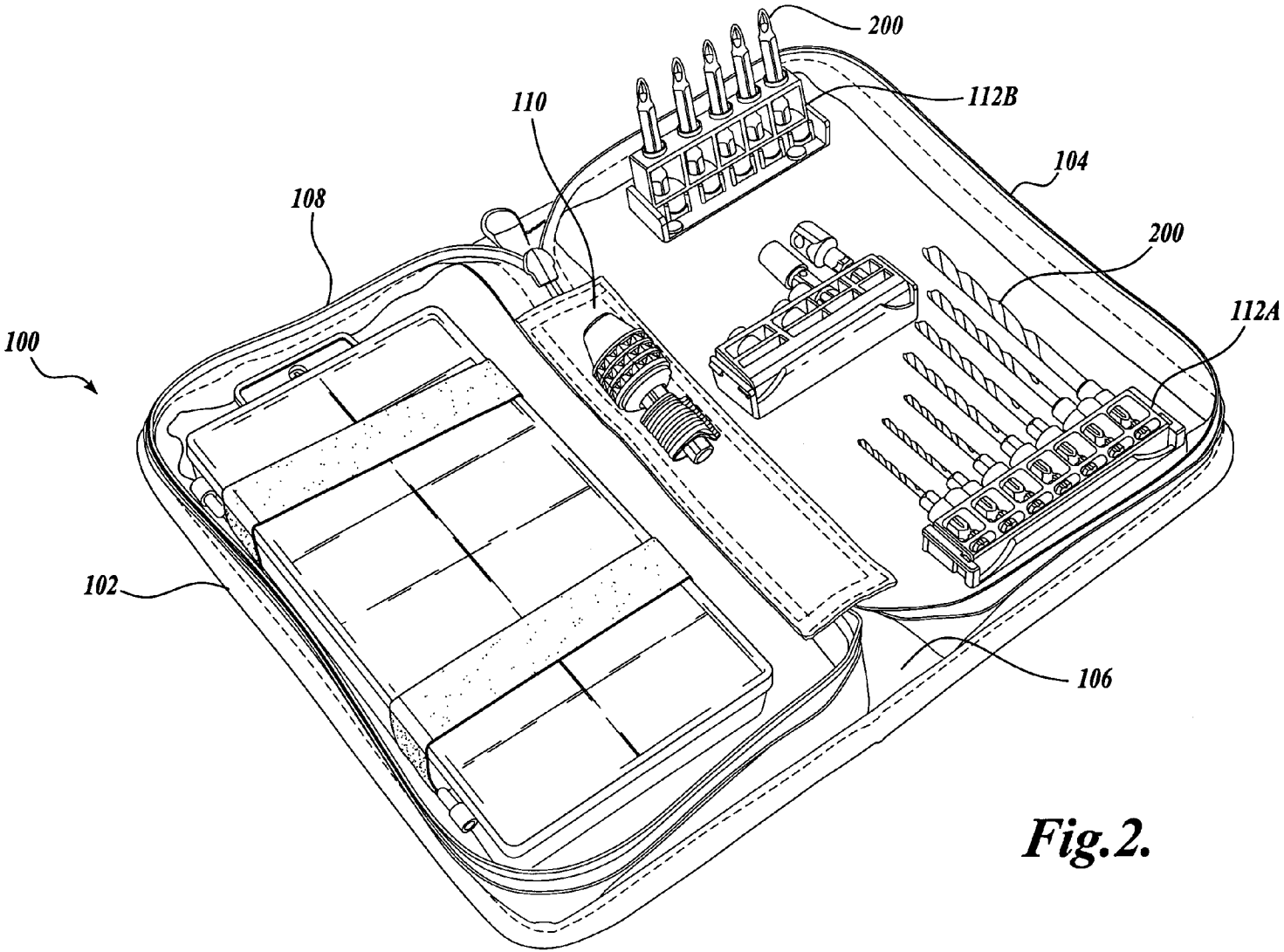
FIG. 2 is a perspective view of the tool holder of FIG. 1 with the tool holder shown in an open position.

FIGS. 1-8 illustrate a tool holder 100 constructed in accordance with one embodiment of the present disclosure. Referring to FIG. 1, the tool holder 100 may be formed in a clam shell design, having a top portion 102 hingedly coupled to a bottom portion 104 about a hinge 106. The tool holder 100 may be transitioned from a closed position as shown in FIG. 1, to an open position as shown in FIG. 2. In the closed position, a securing assembly 108 may be used to removably couple the top portion 102 to the bottom portion 104. In the illustrated embodiment, the securing assembly 108 is a zipper, however it should be noted that the securing assembly 108 may take other forms, a few suitable examples being clasps, clips, etc. Further, although the tool holder 100 is illustrated as a soft-sided bi-fold assembly, it should be apparent that other designs, such as a hard-sided bi-fold, hard-sided tri-fold, and soft and hard sided no-fold containers, are also within the scope of the present disclosure.

The tool holder 100 includes a flexible stiffening core 142, one suitable example being a core made of a flexible sheet of plastic, which is wrapped with a fabric material 138 and 140, one suitable example being nylon.

Referring now to FIG. 2, the tool holder 100, as noted above, is shown in an open position with the top and bottom portions 102 and 104 pivoted relative to one another about the hinge 106. In the open position, a user has access to a variety of tool accessories 200 stored within an inner enclosure 110 of the tool holder 100. The inner enclosure 110 is defined by the top and bottom portions 102 and 104 and the hinge 106 when the tool holder 100 is in the closed position of FIG. 1.

Disposed within the inner enclosure 110 are one or more tool carriers 112A and 112B, collectively referred to as "tool carriers 112." The tool carriers 112 may be used to removably hold one or more tool accessories 200 within the inner enclosure 110. The tool carriers 112 may be transitioned between a stored, flat position as shown for tool carrier 112A and an inclined, or removal position, such as shown for tool carrier 112B, in which a specific tool accessory 200, such as a screw driver bit, can be selected and removed for use.

Figure 3:
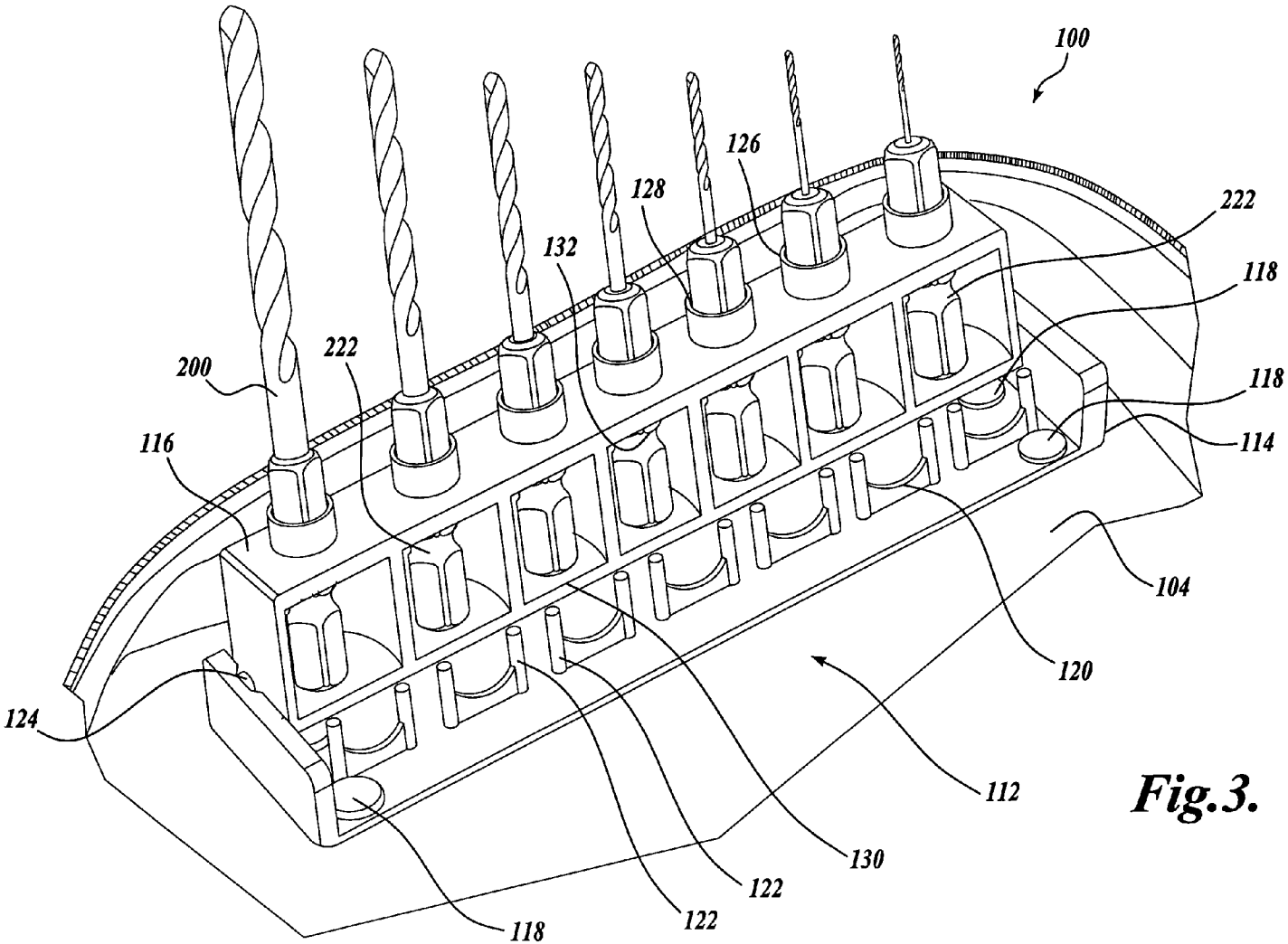
FIG. 3 is a detail perspective view of a tool carrier of the tool holder of FIG. 1, the tool carrier shown in a removal position.

The tool carriers 112 may be best understood by referring to FIG. 3. Although only one of the tool carriers is described in greater detail for the sake of brevity, the description applies to the other tool carriers. The tool carrier 112 includes a base portion 114 and a holder portion 116. The base portion 114 may be secured to the tool holder 100 by any suitable means, such as fasteners, adhesives, sewing, integrally forming the base portion 114 with the tool holder 100, etc. In the illustrated embodiment, the base portion 114 is coupled to the bottom portion 104 of the tool holder 100 by one or more fasteners 118. In the illustrated embodiment, the fasteners 118 are in the form of rivets.

The base portion 114 also includes one or more retaining assemblies 120. The retaining assemblies 120 may be used to selectively retain tool accessories 200 within the tool carrier 112. In the illustrated embodiment, the retaining assemblies 120 are used to retain tool accessories 200 to the tool carrier 112 when the tool carrier 112 is in the stored position and release the tool accessories 200 for removal when the tool carrier 112 is in the removal position.

The retaining assemblies 120 may include an interlocking structure 122 adapted to cooperatively interface with a cooperatively shaped interlocking structure 222 on the tool. In the illustrated embodiment, the interlocking structure 122 of the tool carrier 112 is in the form of two posts or protrusions. The posts or protrusions are adapted to be received within the cooperatively shaped interlocking structure 222 suitably formed on the tool accessory 200. The cooperatively shaped interlocking structure 222 of the tool accessory of the illustrated embodiment is in the form of a waist, or reduced diameter portion of the tool accessory 200.

Figure 6:
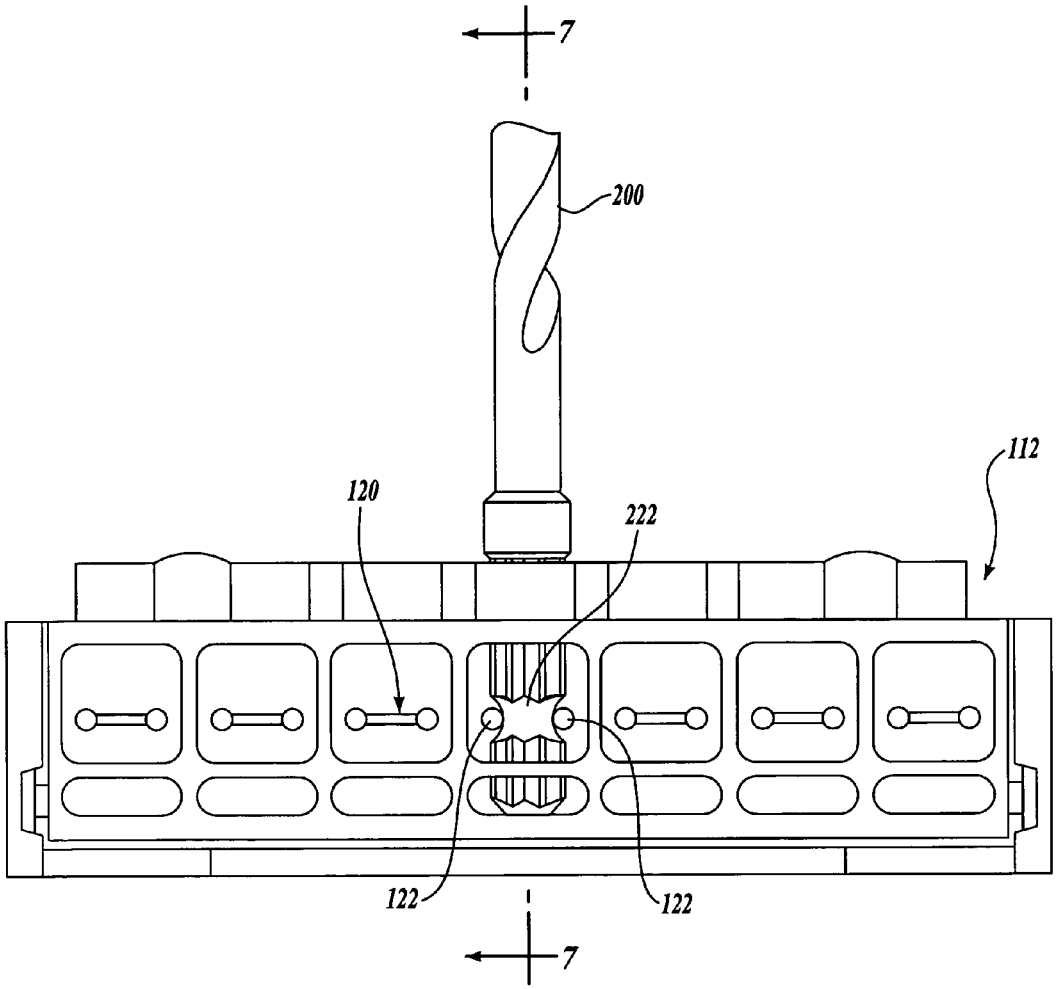
FIG. 6 is a detail top planar view of the tool carrier of FIG. 4, the tool carrier shown in the stored position with six of the tool accessories shown in FIG. 4 removed for clarity.

As best shown in FIG. 6, when the tool carrier 112 is in the stored position, the interlocking structure 122 of the tool carrier 112 interfaces with the cooperatively shaped interlocking structure 222 of the tool accessory 200 to retain or impede the tool accessory 200 from removal from the tool carrier 112. However, when the tool carrier 112 is placed in the removal position, as shown in FIG. 3, the interlocking structures 122 and 222 are spaced from one another, and the tool accessory 200 may be removed from the tool carrier 112.

Figure 4:
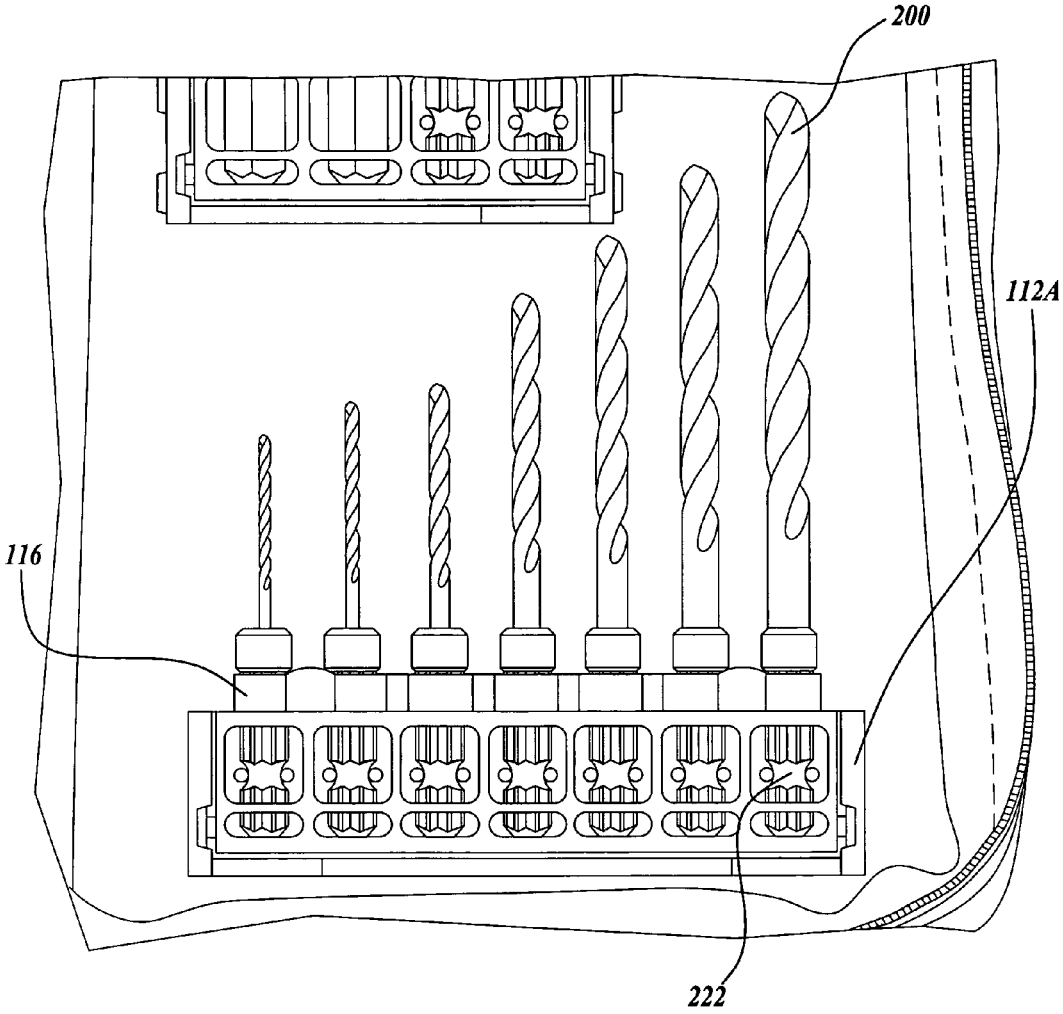
FIG. 4 is a detail to planar view of the tool carrier of FIG. 3, the tool carrier shown in a stored position.
Figure 5:
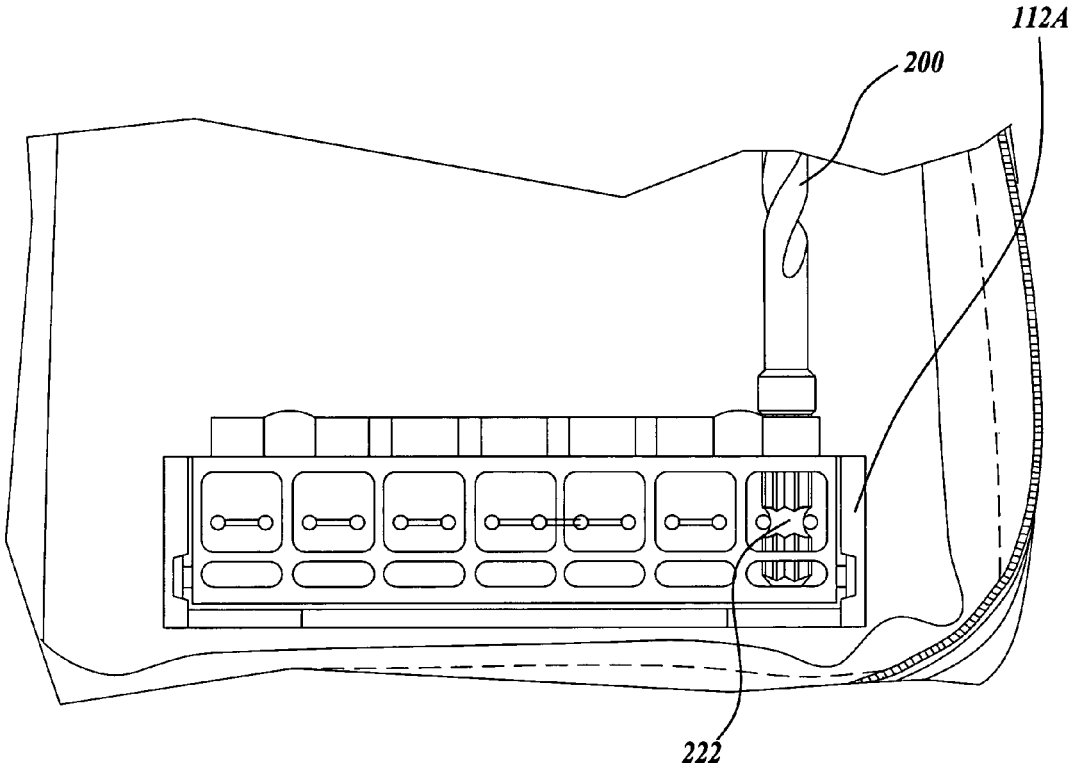
FIG. 5 is a detail top planar view of the tool carrier of FIG. 4, the tool carrier shown in the stored position with six of the tool accessories shown in FIG. 4 removed for clarity.

Referring back to FIG. 3, the holder portion 116 may be pivotally coupled to the base portion 114 by a pivot assembly 124. The holder portion 116 may be pivoted relative to the base portion 114 about the pivot assembly 124 between the removal position (FIG. 3) and the stored position (FIG. 4).

The holder portion 116 may include one or more holder assemblies 126. The holder assemblies 126 may be used to retain a tool accessory 200 in a predetermined position within the tool holder 100. In the illustrated embodiment, the holder assemblies 126 permit a tool accessory 200 to be slid in and out of the holder assembly 126. Each holder assembly 126 includes an aperture 128 sized and shaped to receive a tool accessory 200. The tool accessory 200 is deposited into the holder assembly 126 until it contacts a stopper plate 130.

The holder assembly 126 includes a second aperture 132. The second aperture 132 is sized and located to permit the retaining assemblies 120 to at least partially extend therethrough (when the tool carrier 112 is in the stored position) to engage the tool accessory 200 to aid in retaining the tool 200 to the tool carrier 112.

Operation of the tool holder 100 may be best understood by referring to FIGS. 1-8. Starting from the closed position of the tool holder 100, a user opens the tool holder 100 by unzipping the securing assembly 108 and opens the tool holder 100 like a book into the open position of FIG. 2. The user then locates the tool accessory 200 which the user desires to use. The tool carrier 112 having the selected tool accessory 200 is then rotated from the stored position (see tool carrier 112A) to the removal position (see tool carrier 112B). The tool accessory 200 is then removed from the tool carrier 112, used, and replaced. Once replaced, the tool carrier 112 is returned to the stored position, the tool holder 100 closed, and retained in the closed position by the securing assembly 108.

Figure 7:
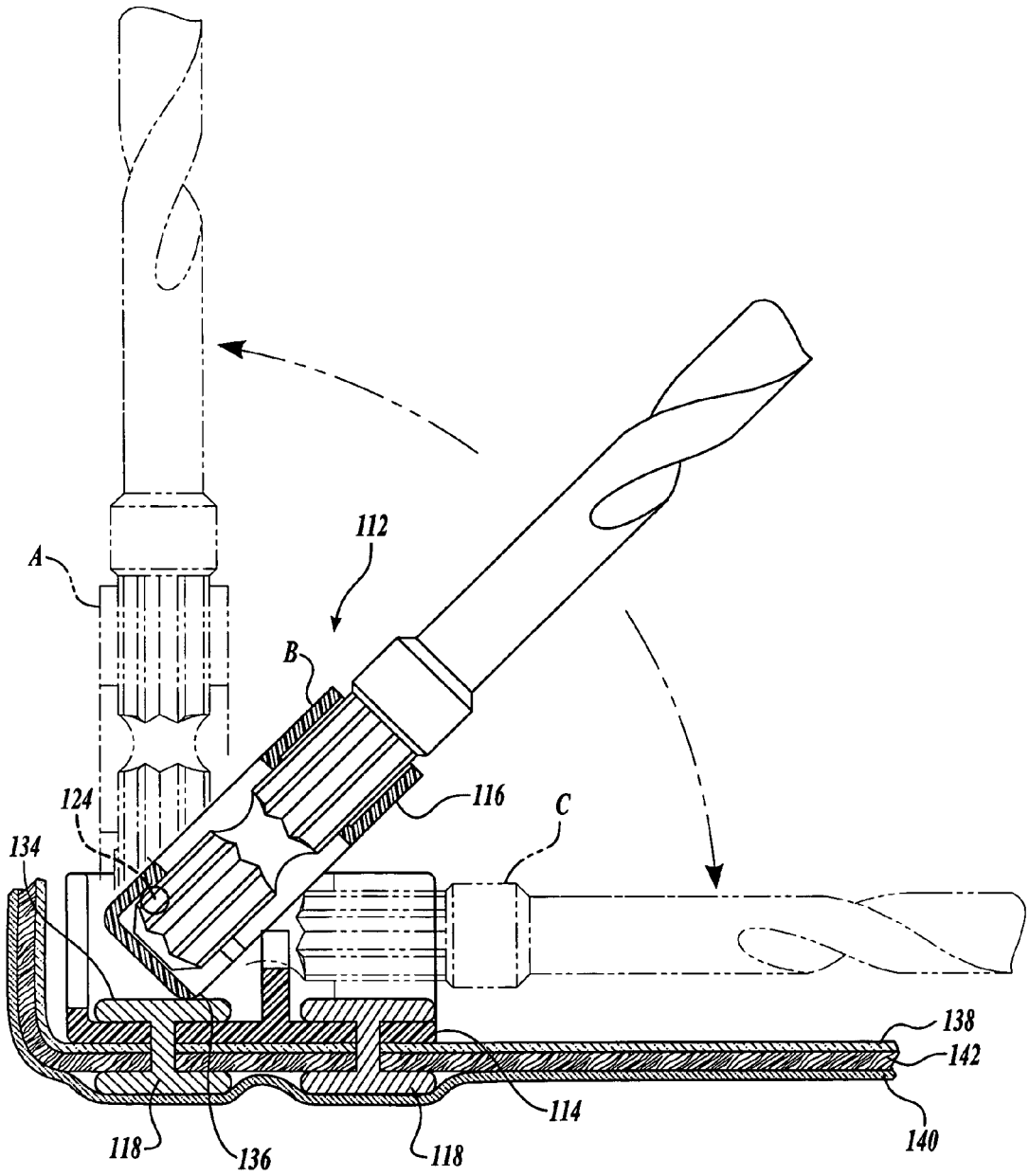
FIG. 7 is a cross-sectional view of the tool holder of FIG. 6, the cross-sectional cut taken substantially through Section 7-7 of FIG. 6 with a holder portion of a tool carrier shown in solid lines in an intermediate position, and in phantom lines in a stored position and a removal position.
Figure 8:
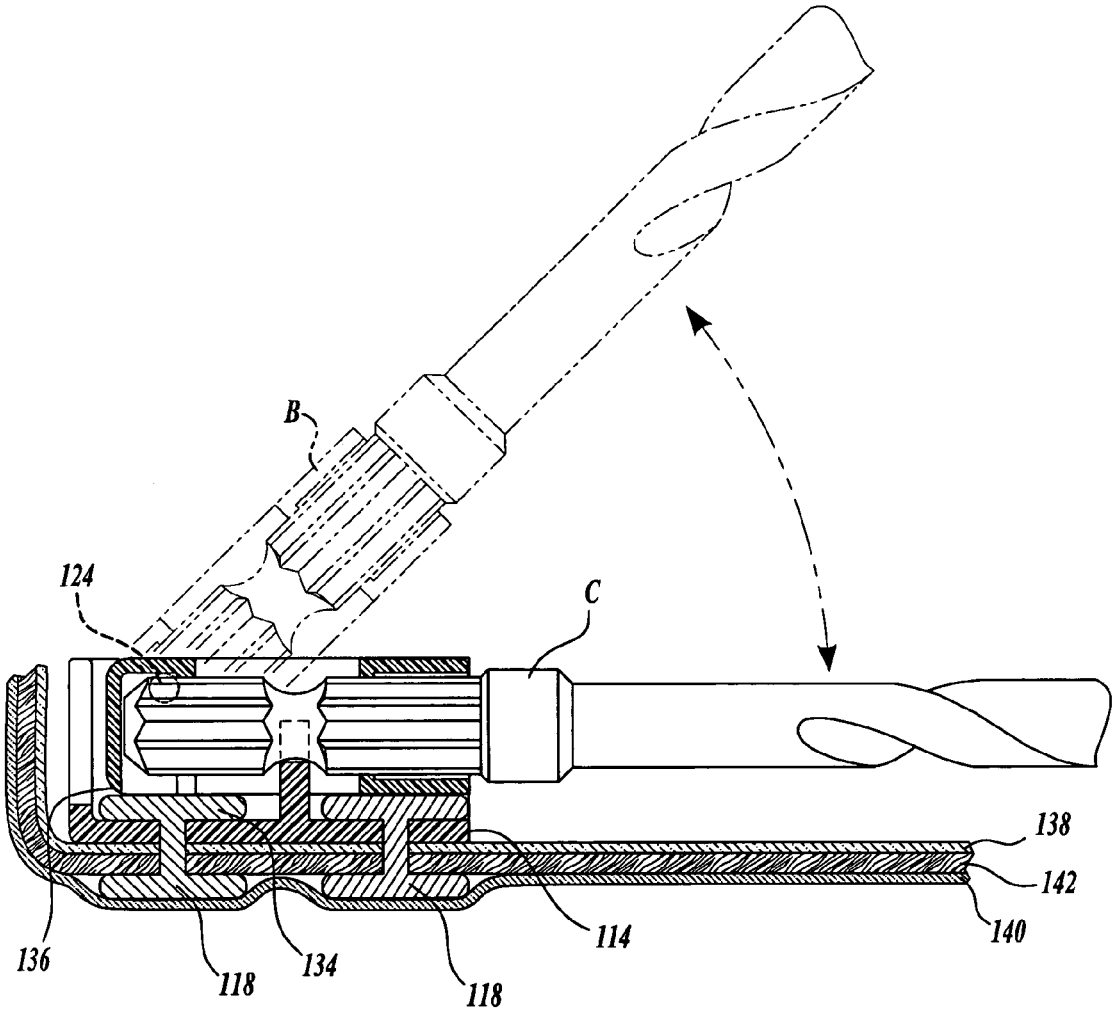
FIG. 8 is the tool holder of FIG. 7 with the holder portion of the tool carrier shown in solid lines in the stored position and in phantom lines in the intermediate position.

Referring to FIG. 7 and focusing more closely on the operation of the tool carrier 112 during transition from the stored position (generally designated as "C" in FIG. 7) to the removal position (generally designated as "A" in FIG. 7), the tool carrier 112 may be formed to provide means for impeding inadvertent transitioning of the tool carrier 112 from the stored position to the removal position, and/or the removal position to the stored position. In other words, the tool carrier 112 includes means for selectively retaining the tool carrier 112 in either the stored or removal position.

In the illustrated embodiment, this aspect is accomplished through interaction of an interference member 134 coupled to the base portion 114 of the tool carrier 112 and a follower 136 coupled to or integrally formed with the holder portion 116 of the tool carrier 112. The interference member 134 may be positioned so as to be in the path of the follower 136 as the follower 136 rotates during movement of the holder portion 116 from the stored position C to the removal position A. Thus, as the holder portion 116 is rotated from the stored position C toward an intermediate position (generally designated as "B" in FIG. 7), the follower 136 engages the interference member 134.

The engagement of the follower 136 against the interference member 134 impedes the free rotation of the holder portion 116 to the removal position A. This engagement between the interference member 134 and the follower 136 defines an interference fit between these two members. However, the application of a load over a predetermined amount will result in the follower 136 to slide over the interference member 134 such that the holder portion 116 can be placed in the removal position A.

The magnitude of the load needed to rotate the holder portion 116 from the stored position A is determined by the amount of interference (i.e. the distance the interference member 134 protrudes into the path of the follower 136), the coefficients of friction of the follower 136 upon the interference member 134, the amount play associated with the interference member 134 and the holder portion 116 (i.e. how much the interference member 134 can move away from the holder portion 116 when a force is applied), the hardness of the materials used in constructing the interference member 134 and the follower 136, etc.

Once the holder portion 116 is in the removal position A, the holder portion 116 is impeded from inadvertently rotating back to the stored position C by the interference relationship of the interference member 134 and the follower 136, in the same manner as described above when the holder portion 116 is rotated from the stored position C to the removal position A.

The interference member 134 may be the fastener 118 used in securing the base portion 114 to the tool holder 100. This dual use of the fastener 118 as both the interference member 134 and as a fastener 118 for coupling the base portion 114 to the tool holder 100 reduces the complexity of the tool holder 100, assembly costs, and raw material costs, among other things. Although the illustrated and described embodiment uses the fastener 118 as the interference member 134, it should be apparent to those skilled in the art that the interference member 134 may be a separate component from the fastener 118.

Figure 9:
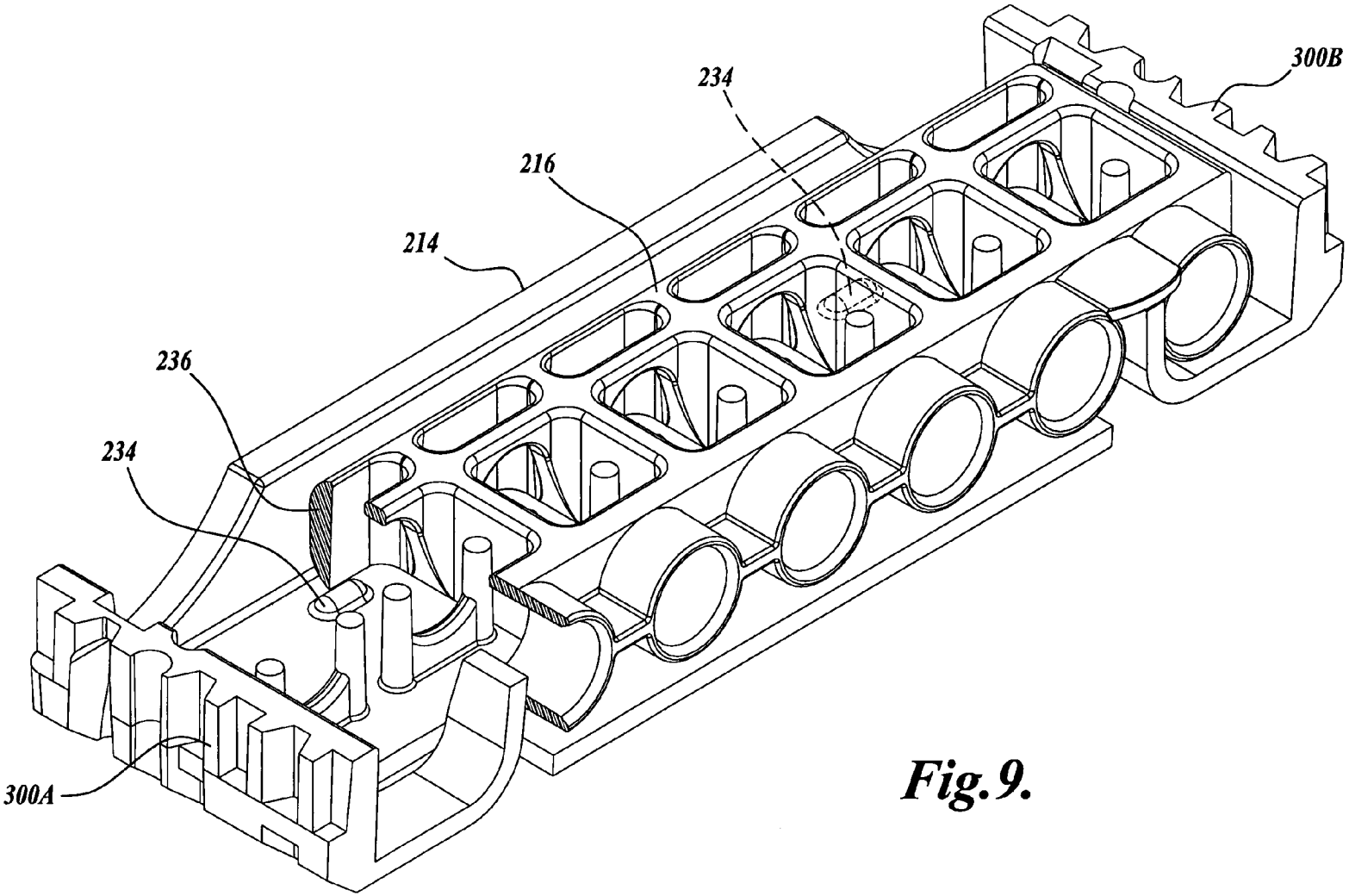
FIG. 9 is an isometric view of a tool holder constructed in accordance with another embodiment of the present disclosure, showing the holder portion partially cut-away to better illustrate certain aspects of the design.

An alternate embodiment of the tool holder described above may be best understood by referring to FIGS. 9-10. The tool holder 200 is substantially identical in materials and operation as the tool holder 100 described above with a few exceptions. One exception is the construct of the base portion 214. The base portion 214 of the alternate embodiment is removably attached within the tool holder (not shown in FIGS. 9-10) by serrated locking portions 300A and 300B formed on the sides of the base portion 214.

The locking portions 300A and 300B are sized and configured to be removably disposed within the tool holder by an interference fit between the locking portions 300A and 300B and correspondingly configured serrated members (not shown) disposed within the interior sidewalls of the tool holder. One such tool holder is described in pending U.S. Patent Application Ser. No. 60/738,186, entitled MODULAR TOOL CASE, and assigned to the assignee of the present application, the disclosure of which is hereby expressly incorporated by reference.

The tool holder 200 also differs from the tool holder 100 by the inclusion of a pair of integrally formed interference members 234. The interference members 234 are positioned and configured to lockingly engage the follower 236 formed in the base of the holder portion 216, thereby selectively retaining the holder portion 216 in the stored position. This may be best understood by referring to FIGS. 10A-10C.

Figure 10A:
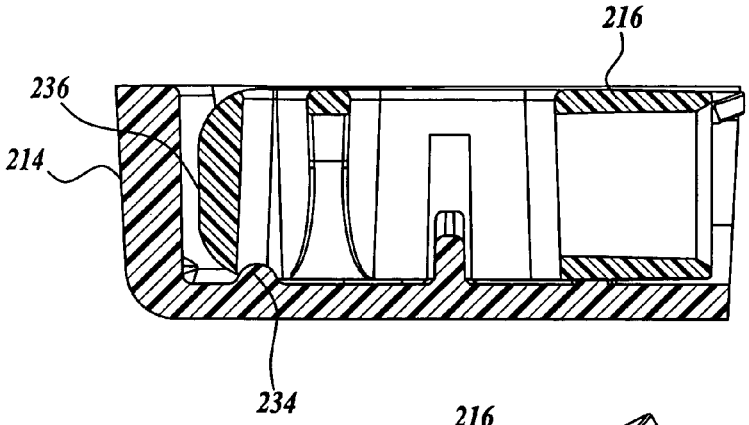
FIG. 10A is a side planar view of the tool holder of FIG. 9, showing the holder portion in a stored position.

In the stored position of FIG. 10A, rotation of the holder portion 216 is restrained by the interference between the follower 236 and the interference members 234. The holder portion 216 is retained in this position until an appropriate opening load is applied to the holder portion 216 by the user of sufficient magnitude to overcome the interference between the follower 235 and the interference members 234. The same considerations described above with respect to this opening load applies.

Figure 10B:
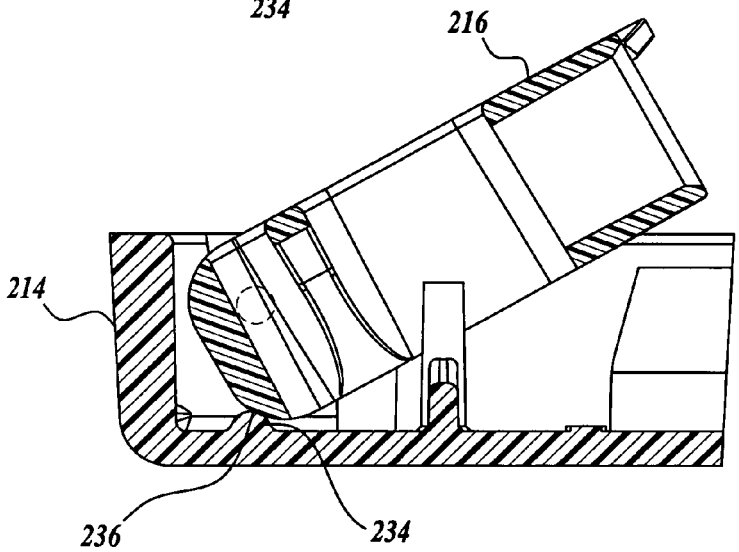
FIG. 10B is a side planar view of the tool holder of FIG. 9, showing the holder portion in an intermediate position.
Figure 10C:
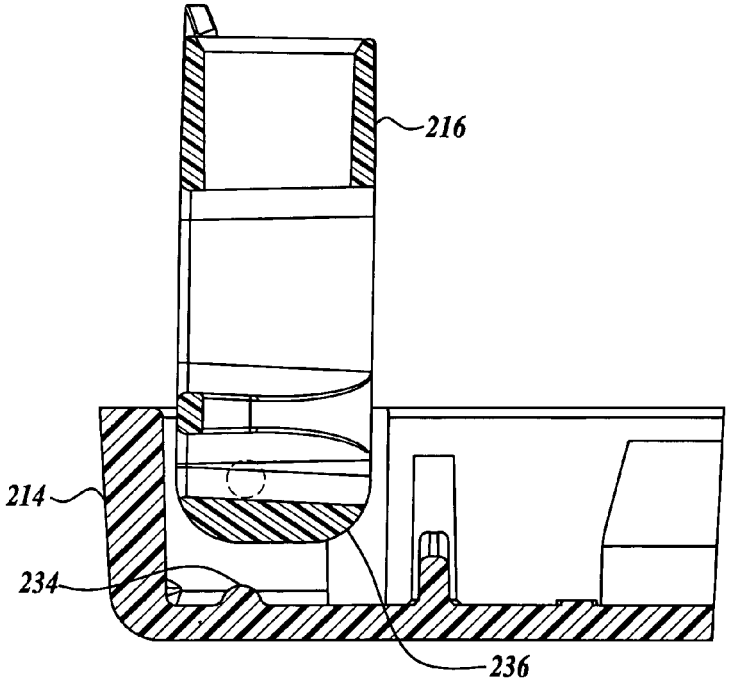
FIG. 10C is a side planar view of the tool holder of FIG. 9, showing the holder portion in a removal position.

As best seen by referring to FIG. 10B, shortly after the opening load is applied to the holder portion 216, the follower 236 slides over the interference members 234, allowing the holder portion 216 to be displaced into the removal position of FIG. 10C.

In the removal position, the follower 236 is displaced from the interference members 234 and tool accessories (not shown) may be either removed or inserted into the holder portion 216 and the holder portion 216 is displaced back into the stored position by reversing the steps described above.

While illustrative embodiments have been illustrated and described, it will be appreciated that various changes can be made therein without departing from the spirit and scope of the invention. As a non-limiting example, although the interference members and follower are illustrated and described as associated with particular elements of the present design, it should be apparent the disclosure is not intended to be so limited. Particularly, the interference members may be formed with the holder portion and the follower may be formed with the base portion. Accordingly, these and other changes are within the scope of the present disclosure.

The embodiments of the invention in which an exclusive property or privilege is claimed are defined as follows:

1. A tool holder assembly, comprising:

(a) a base portion;

(b) a holder portion pivotably disposed within the base portion for reciprocating movement between a stored position and a removal position, the holder portion adapted to receive a tool accessory;

(c) at least one interference member associated with one of either the base portion or the holder portion, the at least one interference member deforming to engage a portion of the other of either the base portion or the holder portion and defining an interference fit therebetween for selectively restraining the holder portion in the stored position until a predetermined load is applied to overcome the interference fit; and (d) an interlocking structure extending from the base, wherein the interlocking structure is (1) at least partially disposed within the holder portion to engage a recess portion of the tool accessory when the tool accessory is disposed within the holder portion and the holder portion is displaced into the stored position to selectively restrain the tool accessory within the holder portion, and (2) disengaged from the recess portion of the tool accessory when the tool accessory is disposed within the holder portion and the holder portion is in the removal position.

2. The tool holder assembly of claim 1, wherein the interlocking structure is a post having a geometry that substantially corresponds to the recess portion of the tool accessory.

3. The tool holder assembly of claim 2, wherein the base portion includes a locking portion configured to permit selective positioning of the tool holder assembly within a tool holder.

4. The tool holder assembly of claim 3, wherein the locking portion includes a serrated portion formed on at least one side of the base portion.

5. The tool holder assembly of claim 1, wherein the base portion includes a locking portion configured to permit selective positioning of the tool holder assembly within a tool holder.

6. The tool holder of claim 1, the holder portion further comprising a follower, reciprocating movement of the holder portion between the stored position and the removal position reciprocating the follower along an arcuate path, wherein the at least one interference member is associated with the base portion and positioned in the arcuate path of the follower.

7. The tool holder of claim 6, wherein the at least one interference member impedes movement of the holder portion from the stored position to the removal position.

8. The tool holder of claim 6, wherein the at least one interference member impedes movement of the holder portion from the removal position to the stored position.

9. The tool holder of claim 6, wherein the at least one interference member is constructed from a first material having a first hardness, and the follower is constructed from a second material having a second hardness, the second hardness being greater than the first hardness.

10. The tool holder of claim 6, wherein the at least one interference member comprises a substantially flat surface for engaging the follower.

11. The tool holder of claim 6, wherein the at least one interference member comprises a fastener coupled to the base portion.

* * * * *